US005112043A

United States Patent [19]

Gilfillian, Jr.

[11] Patent Number: 5,112,043

[45] Date of Patent: May 12, 1992

[54] PHYSICAL THERAPY APPARATUS

[76] Inventor: Henry J. Gilfillian, Jr., P.O. Box 450, Raywood, Tex. 77582

[21] Appl. No.: 592,286

[22] Filed: Oct. 3, 1990

[51] Int. Cl.[5] ..... A63B 23/06; A63B 7/04

[52] U.S. Cl. ..... 482/53; 482/37

[58] Field of Search ..... 272/69, 70, 112, 93, 272/132; D21/192

[56] References Cited

U.S. PATENT DOCUMENTS

| | | |
|---|---|---|
| 1,766,089 | 6/1930 | Wood . |
| 2,042,764 | 6/1936 | Birch . |
| 2,315,485 | 4/1943 | Jones, III . |
| 3,497,215 | 2/1970 | Harrison et al. . |
| 3,572,700 | 3/1971 | Mastropaolo . |
| 3,592,466 | 7/1971 | Parsons . |
| 3,731,917 | 5/1973 | Townsend . |
| 3,747,924 | 7/1973 | Champoux . |
| 3,970,302 | 7/1976 | McFee . |
| 4,496,147 | 1/1985 | DeCloux et al. . |
| 4,555,108 | 11/1985 | Monteiro . |
| 4,687,195 | 8/1987 | Potts . |
| 4,822,029 | 4/1989 | Sarno et al. . |
| 4,848,737 | 7/1989 | Ehrenfield . |

FOREIGN PATENT DOCUMENTS

| | | |
|---|---|---|
| 3502132A1 | 7/1986 | Fed. Rep. of Germany . |
| 1227215 | 4/1986 | U.S.S.R. . |

OTHER PUBLICATIONS

Eqipnews, May/Jun. 1988, Test Product of the Month, No. 30, 215 376-4280.

*Primary Examiner*—Stephen R. Crow

*Attorney, Agent, or Firm*—James E. Bradley

[57] ABSTRACT

A physical climbing apparatus having a sprocket carrier frame structure includes first and second carrier members supported in parallel relation. The frame is made up of members which are extensible. This allows the frame to be supported at selected inclinations. It also allows the apparatus to be collapsed to a substantially flat position for storage and shipping. A pair of rotatable idler sprockets support each chain from deflection caused by a person's weight. The idler sprockets locate closer to the lower end than the upper end and engage a forward run of the chain. A hydraulic rotation control system adjustably controls the rate of rotation of the sprockets.

6 Claims, 5 Drawing Sheets

Fig. 1
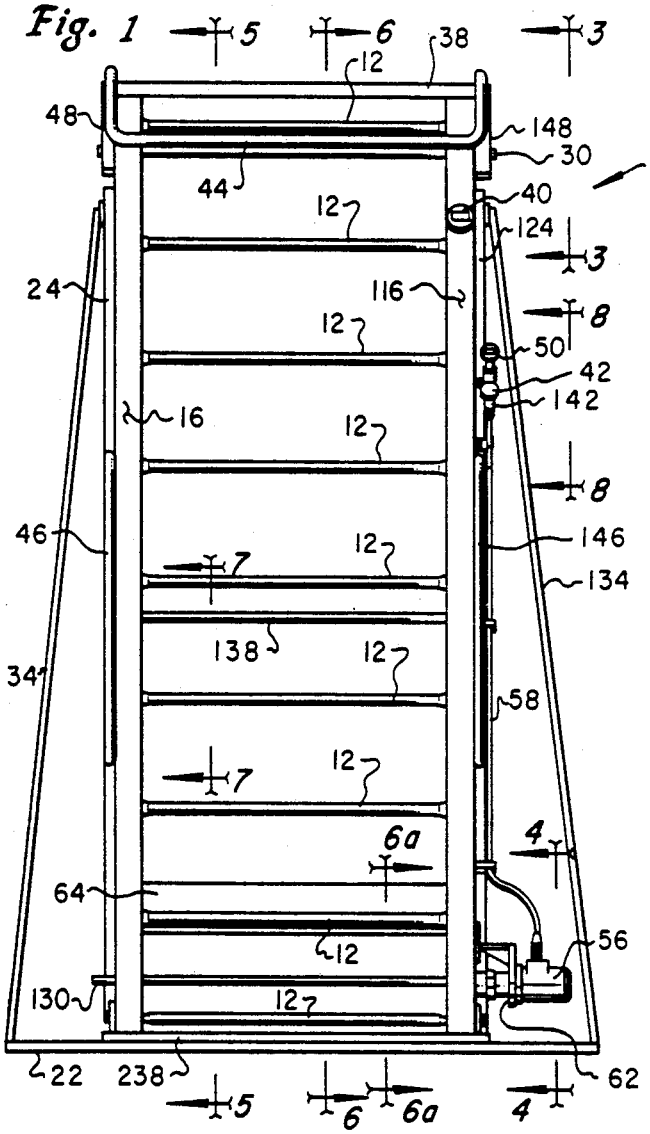
Fig. 2
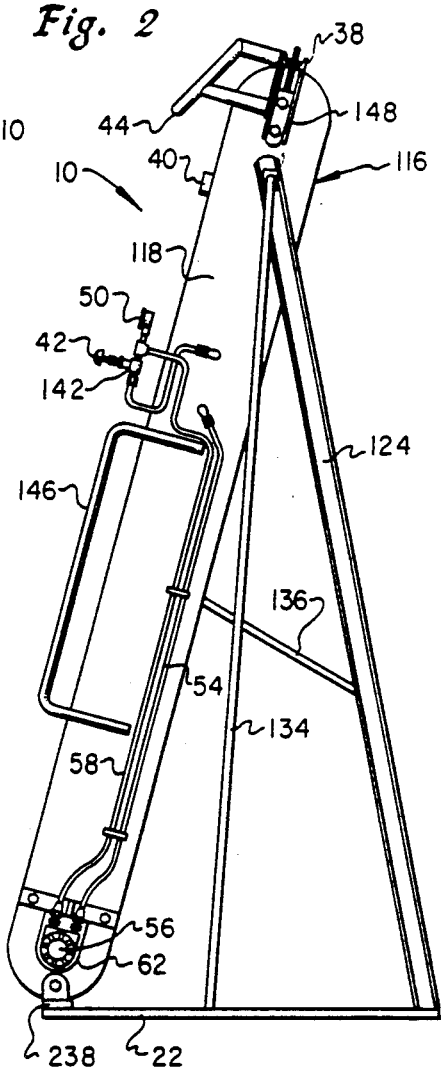
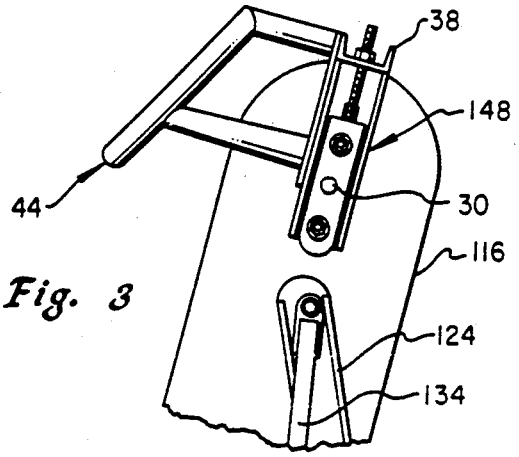
Fig. 3
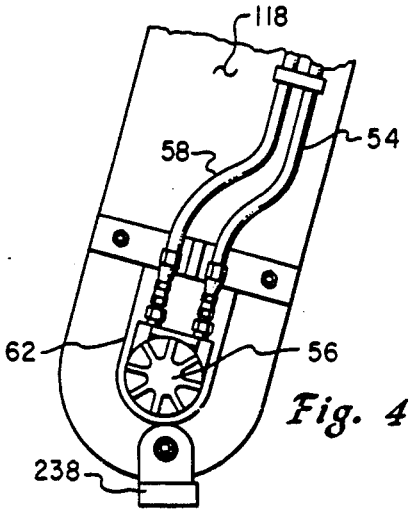
Fig. 4

PHYSICAL THERAPY APPARATUS

BACKGROUND OF THE INVENTION

This invention generally relates to physical therapy apparatus and more particularly to physical therapy climbing apparatus which may be continuously operated by a person to exercise the person's legs, arms and torso the same as if the person were climbing a ladder.

As mentioned in the prior art, medical research has shown that regular vigorous exercise helps to restore the body into good condition following injuries such as incurred from auto or motorcycle accidents. The present invention was conceived and developed for this purpose.

Common means of obtaining vigorous exercise are swimming, climbing, basketball, and tennis. However, many people find these forms of exercise are too difficult following surgery or a broken bone, for example. Walking is another common form of physical therapy but requires either an indoor track or exposure to traffic and inclimate weather conditions.

Because of these difficulties, various types of exercise devices have been developed for use at a stationary site such as a clinic, the home, or the like. Among these are exercise stair devices, the rowing machine, the stationary exercise bicycle, and the endless belt walker or treadmill as disclosed in the prior art.

Prior art exercise ladder devices are known. However, they have large frames. They cannot be readily collapsed for storage when not in use. Transporting requires extensive dissambly.

SUMMARY OF THE INVENTION

The physical therapy climbing apparatus of this invention has a combination sprocket carrier frame which includes a first carrier member and a second carrier member support spaced apart in parallel relation and at an inclination of about 70-80 degrees with respect to horizontal. Each carrier member has an elongated U-shape having a web and a pair of flanges extending at substantially right angles from each side of the web and with the flanges joining together at each end to close the ends of each carrier member. The carrier member is connected to position the flanges of each carrier member toward the other carrier member. At least two cross-bracing members are respectively connected between each end of each carrier member to support the carrier members as disposed. A pair of sprocket shafts are rotatably mounted between the respective ends of the carrier members. A pair of chain sprockets are mounted respectively on each of the shafts for rotation with the shafts and within the flanges of each carrier member. A pair of endless sprocket chains are respectively mounted around each pair of sprockets as disposed within the flanges of a respective carrier member. A plurality of elongated rigid members are mounted at designated intervals along the length of each chain and transversely across the distance between the chains to form bars or rungs for a climbing person.

At least one pair of rotatable idler sprockets are respectively mounted to the webs and between the flanges of each of the carrier members to support each chain from deflection as can be caused by the weight of a person climbing the apparatus. A carrier member support positions the carrier frame for operation at the designated angle. A chain tension adjustment device is connected to one of such sprocket shafts to respectively adjust the tension of each of said chains. A hydraulic rotation control system is connected to one of these sprocket shafts for adjustably controlling the rate of rotation of the sprockets and the corresponding linear movement of the rungs responsive to the weight of a person and a desired rate of movement.

The apparatus further includes a supportive grasping bar connected near the top of the apparatus and between the carrier members to extend outwardly for grasping by the climbing person. A floor detection plate is mounted above the lowest sprocket and between the carrier members to deflect the person's foot at the bottom. The apparatus also includes a side rail respectively connected parallel to each carrier member to extend outwardly for grasping by the climbing person.

The hydraulic rotation control system includes a hydraulic flow rotation control adjustment valve mounted near the center of the carrier member to be available for ready adjustment by the climbing person. The flow control means includes a hydraulic pump rotatably connected to one of the sprocket shafts. The adjustment valve is connected to the outlet of the pump. A hydraulic reservoir is connected to the outlet of the adjustment valve. The outlet of the reservoir is connected to the inlet of the pump. A hydraulic indicating device is connected between the pump and the control valve and calibrated to indicate the pump discharge hydraulic pressure as being the weight pushed down by the climbing person to move the steps downwardly at a designated rate. A movement counting means is connected to indicate the accumulative movement of the steps by the climbing person.

An extendable and retractable support structure is connected to the carrier frame and includes the carrier frame, carrier member support structure, and a base structure connected with the carrier frame and the carrier member support structure to be extended into operating position for use and into retracted position for transfer or storage.

BRIEF DESCRIPTION OF THE DRAWINGS

FIG. 1 is a front elevational view illustrating the exercise ladder as normally used;

FIG. 2 is a right side elevation showing further details of the exercise ladder;

FIG. 3 is an enlarged view taken at 3—3 of FIG. 1;

FIG. 4 is an enlarged detail view taken at 4—4 of FIG. 1;

DETAILED DESCRIPTION OF THE PREFERRED EMBODIMENT

Figure 5:
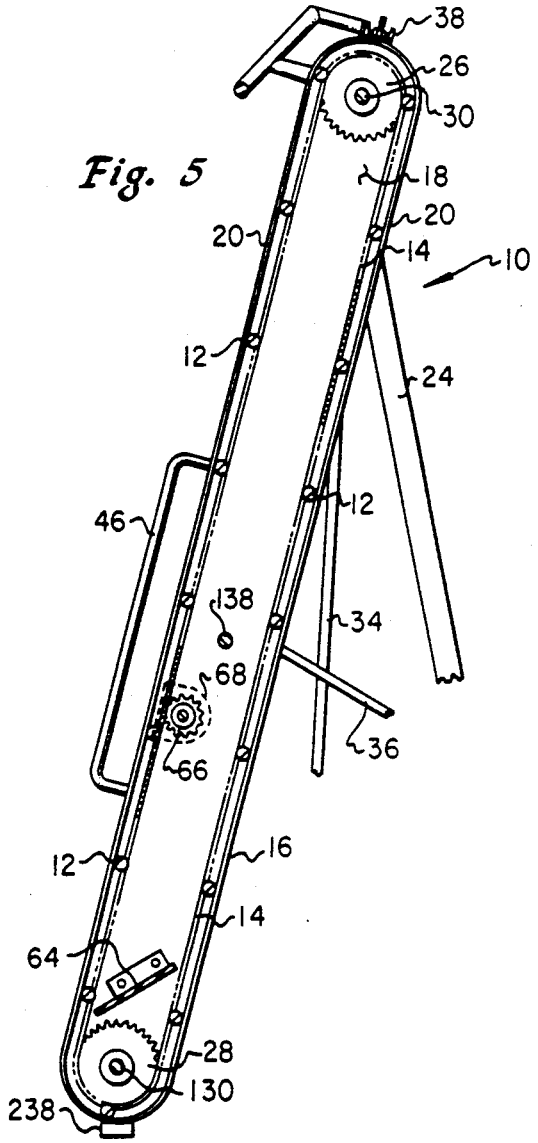
FIG. 5 is an elevational view taken at 5—5 of FIG. 1 and showing the chain and sprockets as mounted within the left carrier member.

Now referring to FIG. 1, there is shown a physical therapy ladder apparatus 10 which presents a plurality of rungs or bars 12 for use by an exercising person, which rungs are connected to flexible tension members (not shown) such as roller chains. An adjustable modulator handle 42 is exposed for use on the right side of the device 10 for the person operating the device to adjust or modulate the movement rate of the rungs 12 in proportion to the person's body weight and the desired rate of climbing. The carrier frame 17 of the apparatus 10 includes two U-shaped carrier members 16 and 116. The carrier frame structure is mounted on a base 22 which is adjustable as later described.

Figure 6:
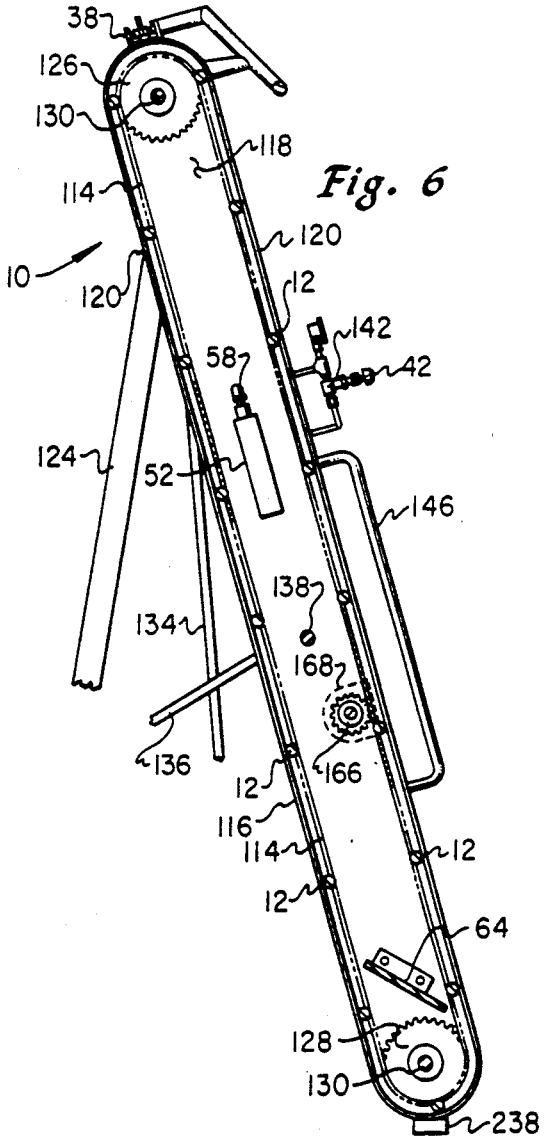
FIG. 6 is an elevational view taken at 6—6 of FIG. 1 and showing the detail of the right chain and sprockets and hydraulic system as mounted with the right carrier frame.
Figure 7:
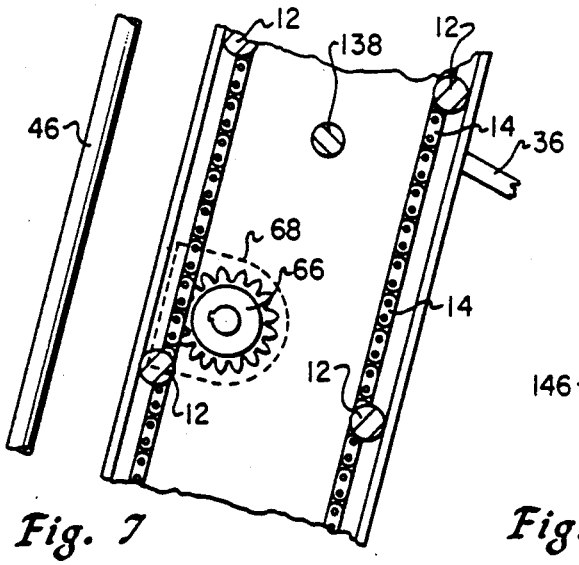
FIG. 7 is an enlarged elevational view taken at 7—7 of FIG. 1 and showing one of the idler sprockets along with its appropriate protective guard.
Figure 8:
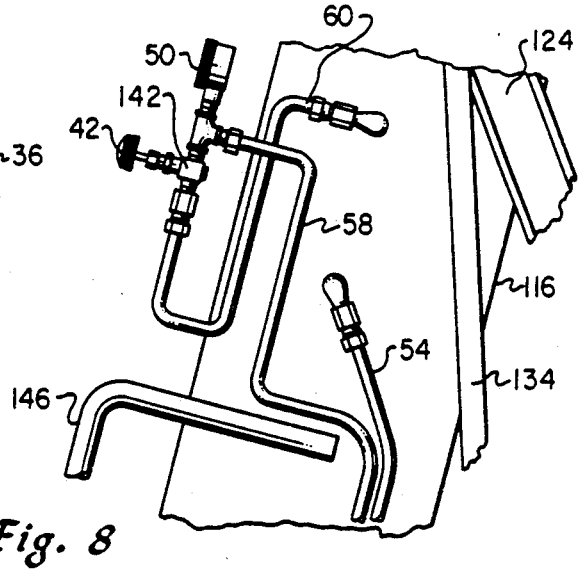
FIG. 8 is an enlarged elevational view taken at 8—8 of FIG. 1 and showing some of the piping detail for the hydraulic control system.

As best shown with reference to FIGS. 1 and 2 taken with FIGS. 5 and 6, each of the U-shaped carrier members 16 and 116 include a web 18 and 118 with respectively two flanges 20 and 120 as shown. The frame 17 is adjustably supported by rear support members 24 and 124 to a desirable angle of inclination with respect to horizontal of about 70 to 80 degrees. As best shown in FIGS. 5, 6, and 7, roller chains 14 and 114 are respectively mounted around upper chain sprockets 26 and 126 and lower chain sprockets 28 and 128. The sprockets are supported within the carrier members 16 and 116 by upper and lower sprocket shafts 30 and 130 respectively as shown. The frame 17 is laterally supported from the base 22 by struts 34 and 134 respectively connected to the carrier members 16 and 116 as shown. Additional supporting rigidity is provided by braces, 36 and 136 connected between the carrier members 16 and 116 and the rear legs 24 and 124 as shown. The carrier members 16 and 116 of the frame 17 are rigidly supported by means of cross-support members 38, 138, and 238 as respectively shown in FIGS. 1, 5, 6, and 7.

Figure 9:
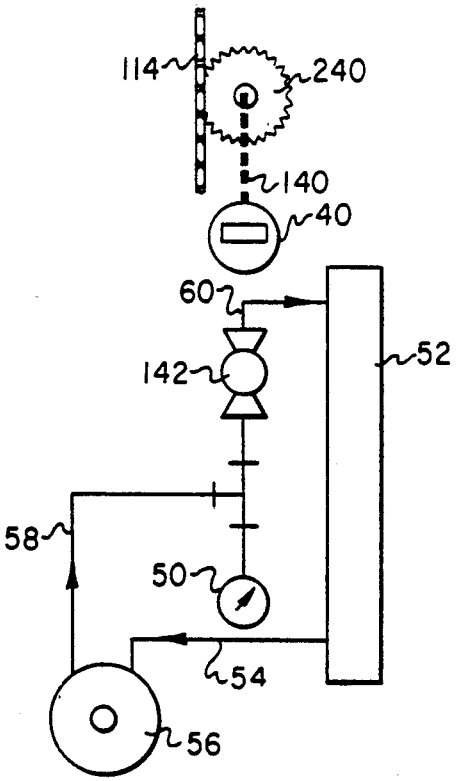
FIG. 9 is a schematic illustration of the hydraulic motion control system and also the odometer as utilized with the present invention.

The accumulative movement of the rungs 12 during operation of the apparatus 10 is detected and indicated by an odometer 40 as shown in FIGS. 1, 2, and 9.

A grasping bar structure 44 is mounted at the upper end of the frame 17 as shown in FIGS. 1 and 2 and serves to better support the exercising person if the need becomes desirable. Side holding rails 46 and 146 are connected respectively to the carrier members 16 and 116 as shown in FIGS. 1, 2, 5, 6, 7, and 8 to provide a sense of security to the exercising person.

The respective tension of the roller chains 14 and 114 is adjusted at the top of the frame 17 by shaft chain adjustment devices 48 and 148. It is desirable for the roller chains 14 and 114 to be relatively taut during operation of the apparatus. In this connection the deflection prevention idler sprockets 60 and 66 are mounted to be engaged with the roller chains 14 and 114 in order to prevent any deflection of the chains 14 and 114 which might occur responsive to the weight of a climbing person. The idler sprockets 60, 66 engage the forward run or length of the chains 14, 114. The point of engagement is closer to the lower sprockets 128 than the upper sprockets 126. Preferably, the point of engagement is about where a user places his feet during exercising. This prevents rearward deflection of the forward length of chains 14, 114 due to the user's weight.

As seen in FIGS. 1, 2, 6, 8, and 9, the adjustment handle 42 is connected to modulate a control valve 142. The modulator valve 142 is connected in series with the hydraulic control system. The hydraulic system includes a reservoir/sump 52 and inlet conduit 54 to a positive displacement pump 56. The pump discharges through a discharge conduit 58, the modulating valve 142, and a sump conduit 600 back into the sump 52. A pressure indicator 50 is connected to sense the pressure between pump 56 and modulating valve 142, and this pressure gauge 50 may be calibrated to indicate the weight or approximate weight of the person using the apparatus. The rate of movement of the rungs 12 is regulated as desired by establishing a flow rate through the modulating valve 142. As shown in the upper part of FIG. 9, the odometer 40 may be connected through a mechanical linkage 140 and a sprocket 240 which may be rotated by movement of the chain 114.

In operation of the exercise apparatus, the weight of the exercising person causes rotation of the pump 56, and this rotation is impeded by the flow of hydraulic fluid through the valve 142. As an example, a person's weight of 150 pounds will be indicated on the indicator 50, and the rungs 12 will be moved downwardly by adjustment of the modulating valve 142 to give a rate of climbing as considered desirable by this person.

The mounting of the hydraulic pump 56 and associated hydraulic piping for the hydraulic control system is best shown in FIGS. 1, 2, and 4. As shown, the pump 56 is mounted in connection with the sprocket shaft 130 by means of a pump mounting bracket 62. The hydraulic conduits 54 and 58 are connected by brackets along the side of the carrier member 116 and web 118 as shown. The rotation of shaft 130 serves to drive the pump 56.

Figure 6A:
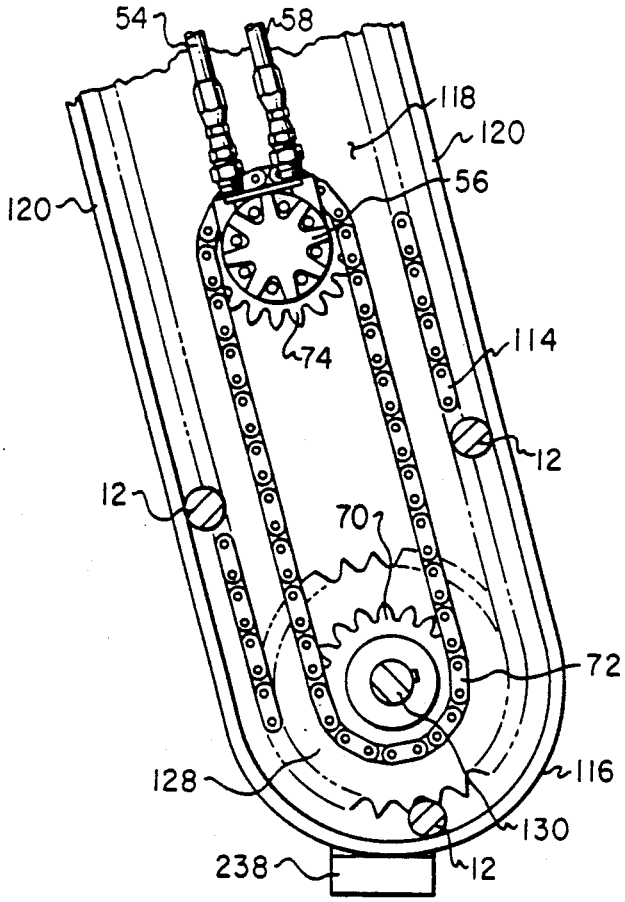
FIG. 6*a* is an enlarged side elevation of an alternate embodiment of the hydraulic pump arrangement as it would appear in a view taken on line 6A—6A of FIG. 1.

FIG. 6A illustrates an alternate mounting for the hydraulic pump 56 such that the frame 17 will have a smaller lateral dimension for crating and shipping as may be desired. In this figure, the pump is mounted inside the carrier member 116 and is connected to the shaft 130 by means of a pump drive sprocket 70 connected through a pump drive chain 72 to drive the pump 56 through a pump sprocket 74 as shown. It is to be noted that this arrangement may be inverted to the top of the frame 17 and be connected as shown to the upper drive shaft 30.

To insure that the climbing person does not get a foot entangled by rotation of the rungs 12 around the sprocket 28 and 128, a foot deflection plate 64 is shown mounted at an appropriate angle immediately above the sprockets 28 and 128. As shown in FIGS. 1, 5, and 6, the deflector plate 64 is rigidly mounted to the webs 18 and 118 of the carrier frames 16 and 116. As shown, it is simple to visualize that a foot of the climbing person will be deflected out of contact with a rung 12 except at the extreme tip of the person's foot. In practice, this gives the climbing person incentive to keep both feet above the deflection plate 64 to avoid discomfort during deflection of a foot.

The pump drive safety guard 68 and 168 as shown in FIGS. 5 and 6 serve to reduce the possibility that a hand or foot of the climbing person will come into contact with the idler sprockets 66 and 166.

Figure 10:
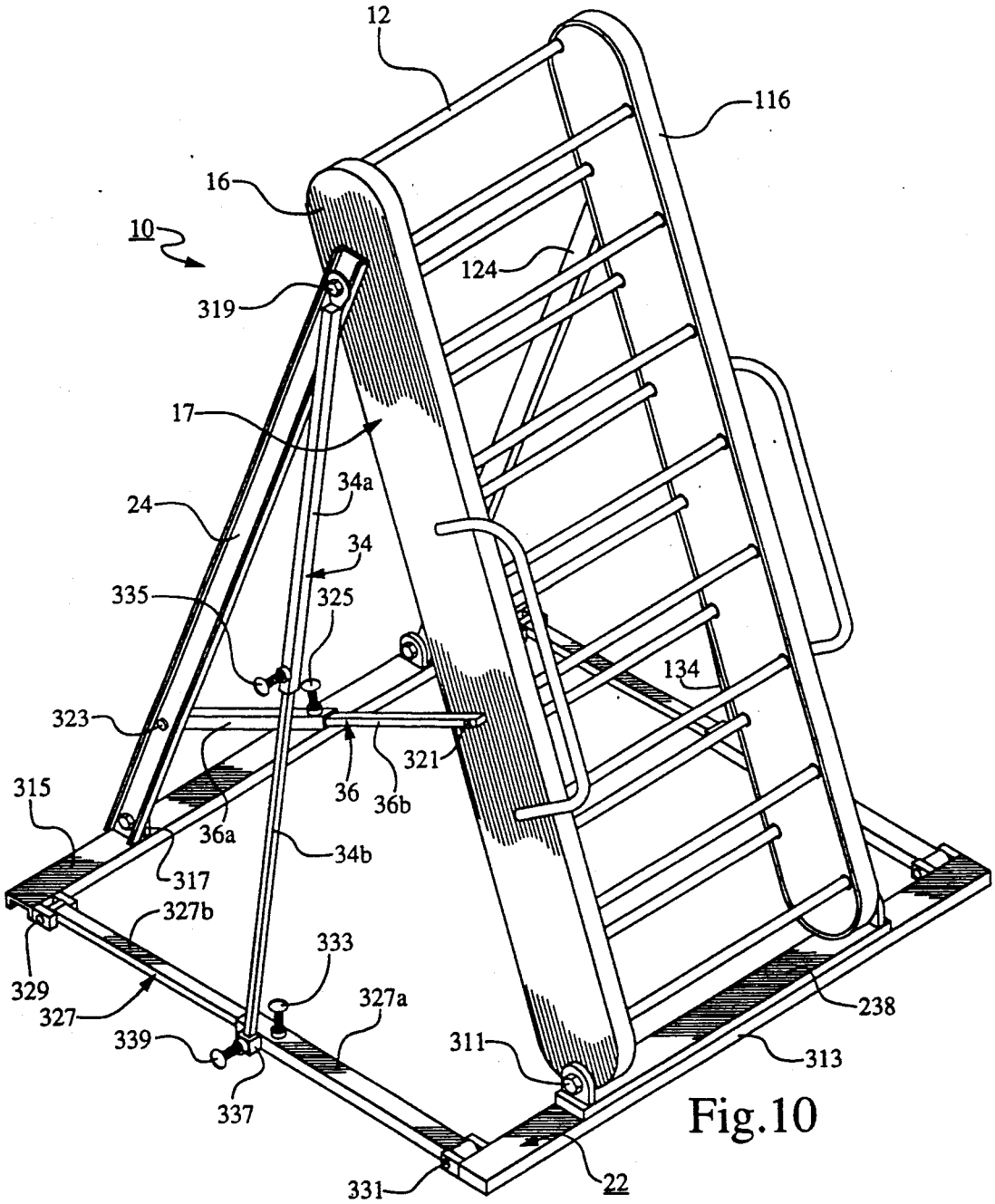
FIG. 10 is a simplified view of the exercise ladder of FIG. 1, but showing the base and supports in more detail.
Figure 11:
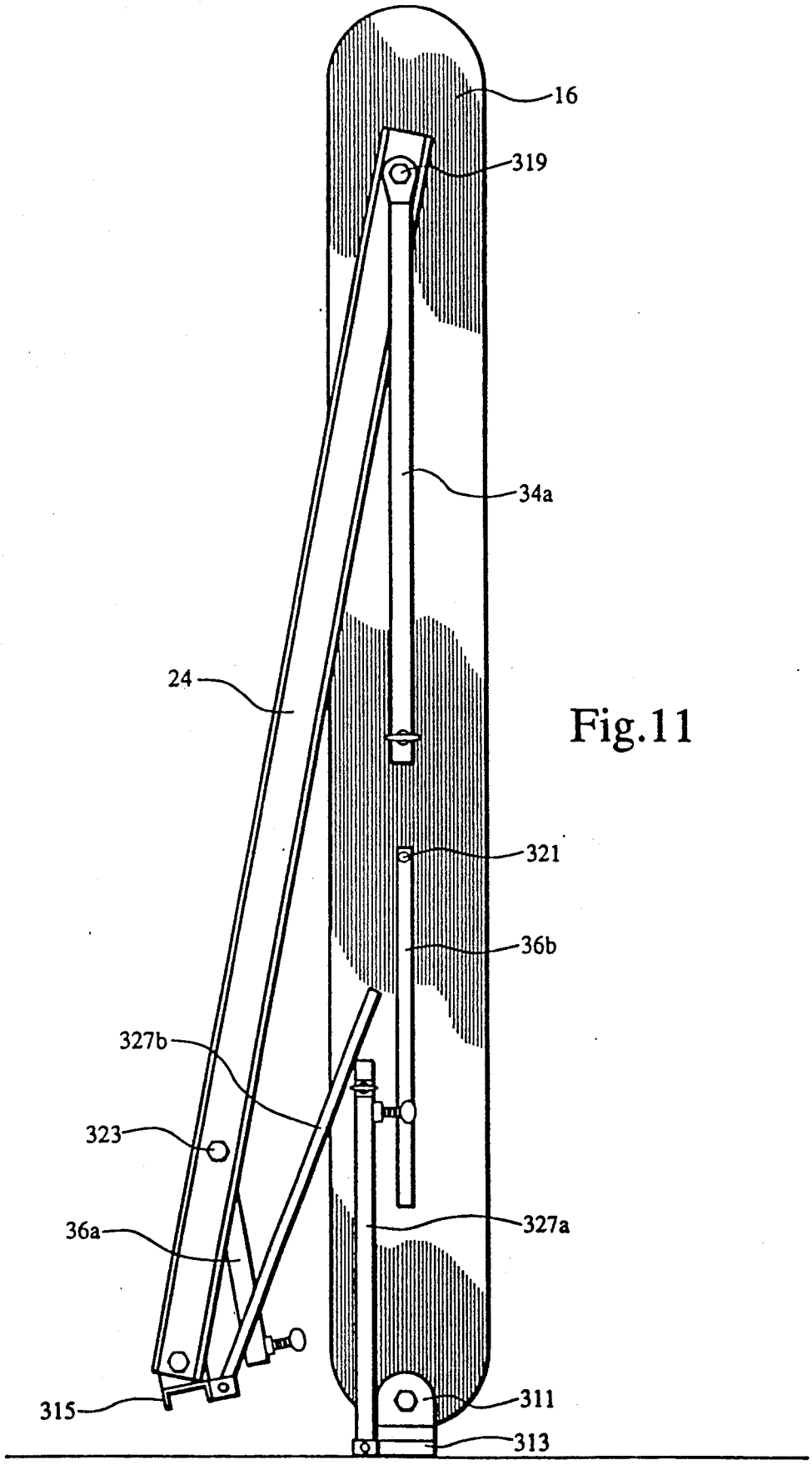
FIG. 11 is a side view of the exercise ladder as shown in FIG. 10, but showing the ladder moving toward a collapsed storage position.

Referring to FIG. 10, the base 22 includes a cross support member 238. The lower ends of the carrier members 16, 116 rigidly mount to the cross support member 238 by brackets 311. The brackets 311 will allow the carrier members 16, 116 to pivot from an inclined position, such as shown in FIG. 10, to a vertical position, such as shown in FIG. 11.

The cross support member 238 is secured by welding to a forward base member 313. The forward base member 313 is parallel to the cross support member 238. The forward base member 313 is longer than the cross support member 238, with ends protruding laterally from each side an equal amount. The ends of the forward base member 313 extend past the carrier members 16, 116 a significant amount.

The legs 24, 124 pivotally mount to a rearward base member 315 by means of brackets 317. Brackets 317 allow the legs to pivot relative to the rearward base member 315. The upper ends of the legs 24, 124 pivotally mount to the carrier member 16, 116 by means of a bolt 319. Bolt 319 is located near the upper end of the carrier members 16, 116. The length of the rearward base member 315 is the same as the length of the forward base member 313. The ends of the rearward base member 315 extend laterally beyond the legs 24, 124.

The braces 36, 136 interconnect the legs 24, 124 with the carrier members 16, 116. The braces 36, 136 are extensible in length. Preferably, each includes an outer member **36*a* and an inner member 36*b* that slidingly locates within the outer member 36*a*. A thumb screw 325 can be tightened to fix the length at any selected position. The inner member 36*b* pivotally connects to one of the carrier member 16, 116 by means of a bolt 321. The outer member 36*a* pivotally connects one of to the legs 16, 116 by means of a bolt 323. Preferably, the bolt 321 is located at a higher point from the base 22 than the bolt 323. This causes the braces 36, 136 to be inclined when the apparatus 10 is in an operating position, such as shown in FIG. 10**.

Horizontal support members 327 connect the outer ends of the forward base member 313 with the rearward base member 315. When in the operating position shown in FIG. 10, each horizontal support member 327 will be in a horizontal plane which also contains the forward base member 313 and rearward base member 315. Each horizontal support member 327 is extensible in length. Each preferably includes an outer member **327*a* and an inner member 327*b*. The inner member 327*b* pivotally mounts to the outer ends of the rearward base member 315 by means of brackets 329. The outer member 327*a* pivotally mounts to the outer ends of the forward base member 313 by means of brackets 331. A thumb screw 333 when tightened will secure the inner and outer members 327*a*, 327*b*** into a desired length.

The struts 34, 134 pivotally mount on their upper ends to the carrier members 16, 116. The bolts 319 secure the upper ends of the struts 34, 134, as well as the upper ends of the legs 24, 124. The struts 34, 134 are extensible in length. Each includes an outer member **34*a* that telescopically receives an inner member 34*b*. A thumb screw 335 will secure the inner and outer members 34*a*, 34*b*** together to the desired length.

The lower end of each inner member **34*b* will slide within a receptacle 337 and be secured by thumb screw 339. The receptacle 337 is located approximately halfway between the forward base member 313 and rearward base member 315. The receptacle 337 is welded to the outer member 327*a* of the horizontal support member 327. The struts 34, 134 incline toward each other from the bottom to the top because the distance between the horizontal supports 327 is greater than the ditance between the carrier members 16, 116**.

The preferred inclination of the carrier members 16, 116 is about 75 degrees relative to horizontal. This inclination can be readily changed by moving the rearward base member 315 toward or away from the forward base member 313. When doing this, the thumb screws 325, 333, 335 and 339 need to be loosened until the desired position has been reached. Then these thumb screws will be tightened again. When moving the rearward base member 315 toward the forward base member 313, the braces 36, 136 and horizontal supports 327 will shorten. The struts 34, 134 will lengthen. The carrier members 16, 116 will become more vertical. When moving the rearward base member 315 away from the forward base member 313, the reverse occurs.

To move the apparatus 10 from the operational position shown in FIG. 10 to a storage position, the thumb screws 325, 333, 335, and 339 will be loosened. The inner strut member **34*b* will be moved up into the outer strut member 34*a* and secured by thumb screw 335. Initially, the rearward base member 315 will be moved a short distance away from the forward base member 313. The inner brace member 36*b* will slide out of the outer brace member 36*a*. The inner horizontal support member 327*b* will slide out of the outer horizontal support member 327*a*. Then the rearward base member 315 will be moved toward the forward base member 313. The horizontal support members 327*b* and 327*a* will be pivoted into vertical positions. The brace members 36*a* and 36*b* will be pivoted into vertical positions. The strut outer members 34*a* will be in a vertical position. The legs 24, 124 will move into a position substantially parallel with the carrier members 16, 116. The carrier members 16, 116 will be pivoted vertical relative to the forward base member 313. The bolts 319 will allow the struts 34*a* to swing inward until in contact with the legs 24, 124. FIG. 11 shows the apparatus 10** in the process of being collapsed, but not yet in a fully collapsed position.

The apparatus has significant advantages. The collapsible frame allows the apparatus to be collapsed into substantially flat position for storage or shipping. The frame will quickly move to an operational position. The inclination can be easily varied because of the extensible members.

The idler sprockets support the chain at a point where the weight of the user is impressed on the rungs. This prevents excessive deflection of the chain.

While the invention has been shown in only two of its forms, it should be apparent to those skilled in the art that it is not so limited, but is susceptible to various changes without departing from the scope of the invention.

I claim:

1. A physical therapy climbing apparatus, comprising in combination:

a pair of spaced apart carrier members, each having an upper end and a lower end;

a pair of sprocket shafts respectively mounted between the carrier members near each end of each of the carrier members;

a pair of chain sprockets mounted on each of the sprocket shafts;

a pair of sprocket chains mounted between the sprocket shafts and around a corresponding sprocket of each of the chain sprockets;

a plurality of cylindrical ladder rungs mounted between the sprocket chains at selected intervals along the lengths of the sprocket chains for receiving a person's foot and grasping by a person's hands;

hydraulic control means connected to one of the sprocket shafts for adjustably controlling the rate of rotation of the sprocket shafts and corresponding linear movement of the sprocket chains;

a forward base member adapted to rest on a floor;

means for pivotally mounting the lower ends of the carrier members to the forward base member for allowing the carrier members to move from a storage position substantially perpendicular to the forward base member to selected inclined positions relative to the forward base member;

a rearward base member adapted to rest on the floor rearward of the forward base member while in an operational position;

a pair of legs, each having an upper end pivotally mounted to one of the carrier members, wherein each of the braces is extensible for selectively varying the lengths of the braces for supporting the frame at selected inclinations relative to the forward base member, and for allowing the legs to be moved forward relative to the carrier members to a storage position near the upper end of the carrier members, each having a lower end pivotally mounted to the rearward base member;

a pair of braces, each pivotally connected between one of the legs and one of the carrier members; and brace extension means for selectively varying the lengths of the braces for supporting the frame at selected inclinations relative to the forward base member, and for allowing the legs to be moved to forward relative to the carrier members to a storage position.

2. The apparatus according to claim 1 wherein the forward and rearward base members have lengths greater than the distances between the carrier members and between the legs, respectively, the foward base member extending laterally past the carrier members and the rearward base member extending laterally past the legs for providing lateral support.

3. A physical therapy climbing apparatus, comprising in combination:

a pair of spaced apart carrier members, each having an upper end and a lower end;

a pair of sprocket shafts respectively mounted between the carrier members near each end of each of the carrier members;

a pair of chain sprockets mounted on each of the sprocket shafts;

a pair of sprocket chains mounted between the sprocket shafts and around a corresponding sprocket of each of the chain sprockets;

a plurality of cylindrical ladder rungs mounted between the sprocket chains at selected intervals along the lengths of the sprocket chains for receiving a person's foot and grasping by a person's hands;

hydraulic control means connected to one of the sprocket shafts for adjustably controlling the rate of rotation of the sprocket shafts and corresponding linear movement of the sprocket chains;

a forward base member adapted to rest on a floor and connected to the lower ends of the carrier members;

the forward base member having a length greater than the distance between the carrier members, and having outer ends protruding laterally beyond each of the carrier members;

a rearward base member adapted to rest on the floor rearward of the forward base member while in an operational position;

a pair of legs, each having an upper end mounted to one of the carrier members near the upper end of the carrier members, each having a lower end mounted to the rearward base member;

the rearward base member having a length substantially the same as the forward base member and having outer ends protruding laterally beyond each of the legs;

a pair of braces, each connected between one of the legs and one of the carrier members;

a pair of horizontal support members, each connected to one of the outer ends of the rearward base member and connected to one of the outer ends of the forward base member; and a pair of struts, each having an upper end pivotally connected to one of the carrier members near the upper end of the carrier member and a lower end connected to one of the horizontal support members.

4. The apparatus according to claim 3 wherein each of the struts is extensible to accommodate different inclinations of the legs and carrier members relative to each other.

5. The apparatus according to claim 4 wherein each of the horizontal support members is extensible to allow different distances between the forward and rearward base members to be selected.

6. A physical therapy climbing apparatus, comprising in combination:

a pair of spaced apart carrier members, each having an upper end and a lower end;

a pair of sprocket shafts respectively mounted between the carrier members near each end of each of the carrier members;

a pair of chain sprockets mounted on each of the sprocket shafts;

a pair of sprocket chains mounted between the sprocket shafts and around a corresponding sprocket of each of the chain sprockets;

a plurality of cylindrical ladder rungs mounted between the sprocket chains at selected intervals along the lengths of the sprocket chains for receiving a person's foot and grasping by a person's hands;

hydraulic control means connected to one of the sprocket shafts for adjustably controlling the rate of rotation of the sprocket shafts and corresponding linear movement of the sprocket chains;

a forward base member adapted to rest on a floor and pivotally connected to the lower ends of the carrier members;

the forward base member having a length greater than the distance between the carrier members, and having outer ends protruding laterally beyond each of the carrier members;

a rearward base member adapted to rest on the floor rearward of the forward base member while in an operational position;

a pair of legs, each having an upper end pivotally mounted to one of the carrier members near the upper ends of the carrier members, each having a lower end pivotally connected to the rearward base member;

the rearward base member having a length substantially the same as the forward base member and having outer ends protruding laterally beyond each of the legs;

a pair of braces, each pivotally connected between one of the legs and one of the carrier members, each brace being extensible and having first and second members slidingly connected together and securable at selected lengths;

a pair of horizontal support members, each pivotally connected between the rearward base member and the forward base member, each support member being extensible and having first and second members slidingly connected together and securable at selected lengths;

a pair of struts, each having an upper end pivotally connected to one of the carrier members near the upper end of the carrier member and a lower end pivotally connected to one of the horizontal support members intermediate the ends of the horizontal support member, each strut being extensible and having first and second members slidingly connected together and securable at selected lengths; and the extensible braces, support members and struts allowing the carrier members to be placed, at selected inclinations and allowing the legs to be brought forward relative to the carrier members into a storage position.

* * * * *